US005403636A

United States Patent [19]

Crum

[11] Patent Number: 5,403,636

[45] Date of Patent: Apr. 4, 1995

[54] MULTI-LAYERED LABELS

[75] Inventor: Brooks Crum, Naperville, Ill.

[73] Assignee: American Labelmark Company, Chicago, Ill.

[21] Appl. No.: 60,264

[22] Filed: May 12, 1993

[51] Int. Cl.[6] ..... G09F 3/00

[52] U.S. Cl. ..... 428/40; 281/2; 281/5; 283/81; 283/105; 428/43; 428/131; 428/137; 428/192; 428/194; 428/343; 428/354; 462/62; 462/63

[58] Field of Search ..... 428/40, 43, 131, 137, 428/192, 194, 343, 354; 283/81, 105; 281/2, 5; 462/62, 63

[56] References Cited

U.S. PATENT DOCUMENTS

| | | | |
|---|---|---|---|
| 1,686,354 | 10/1928 | Wallace | 40/310 |
| 1,896,834 | 2/1933 | Brown | 40/308 |
| 1,924,909 | 8/1933 | Brown | 40/7 |
| 1,949,903 | 3/1934 | Fales | 35/12 |
| 1,974,401 | 9/1934 | Miller | 40/4 |
| 2,093,985 | 9/1937 | Stansbury | 40/2 |
| 2,127,081 | 8/1938 | Brown | 40/7 |
| 2,614,349 | 10/1952 | Barnes | 40/299 |
| 2,706,865 | 4/1955 | Miller | 40/2 |
| 3,638,966 | 2/1972 | Wiersma | 281/21 |
| 3,858,792 | 1/1975 | Volkert | 229/73 |
| 3,859,958 | 1/1975 | Luscher | 118/261 |
| 3,871,639 | 3/1975 | Felix | 270/52 |
| 3,994,118 | 11/1976 | Felix | 53/124 |
| 4,104,816 | 8/1978 | Pingeton | 40/2 R |
| 4,159,586 | 7/1979 | Blum | 40/2 R |
| 4,204,706 | 5/1980 | Blum et al. | 283/21 |
| 4,276,334 | 6/1981 | Sugihara | 428/40 |
| 4,323,608 | 4/1982 | Denny et al. | 428/43 |
| 4,331,327 | 5/1982 | Felix | 271/9 |
| 4,334,672 | 6/1982 | Felix | 270/53 |
| 4,406,650 | 9/1983 | Felix | 493/410 |
| 4,407,524 | 10/1983 | Trautlein | 282/9 R |
| 4,529,229 | 7/1985 | Glibbery | 283/81 |
| 4,534,582 | 8/1985 | Howard | 283/81 |
| 4,621,442 | 11/1986 | Mack | 40/2 R |
| 4,621,837 | 11/1986 | Mack | 283/105 |
| 4,850,613 | 7/1989 | Instance | 281/5 |
| 4,930,812 | 6/1990 | Howard | 281/5 |
| 4,991,878 | 2/1991 | Cowan et al. | 283/81 |
| 5,074,595 | 12/1991 | Hill | 283/81 |
| 5,200,243 | 4/1993 | Van Veen | 428/40 |

FOREIGN PATENT DOCUMENTS

| | | |
|---|---|---|
| WO82/00432 | 2/1982 | European Pat. Off. . |
| 0043179 | 6/1982 | European Pat. Off. . |
| 270850 | 12/1950 | France . |
| 1397787 | 6/1975 | United Kingdom . |
| 2046717A | 11/1980 | United Kingdom . |
| 2054529A | 2/1981 | United Kingdom . |
| 1596306 | 8/1981 | United Kingdom . |
| 2073716A | 10/1981 | United Kingdom . |
| 2119345A | 11/1983 | United Kingdom . |

*Primary Examiner*—Nasser Ahmad
*Attorney, Agent, or Firm*—Rudnick & Wolfe

[57] ABSTRACT

An adhesive label including inner and outer sheets arranged in overlying relation with a multi-page leaflet arranged therebetween. The inner and outer sheets are generally laterally aligned relative to each other along respective first side edges and are adhered to each other along an end region extending laterally inward from the laterally aligned edges of the sheets. The multi-page leaflet is arranged in a folded configuration between the sheets with one folded edge of the leaflet being generally laterally aligned with the second side edge of the inner sheet and the other folded edge of the leaflet being laterally spaced inwardly from the laterally aligned first edges of the sheets. The outer sheet extends over and laterally beyond the second edge of the inner sheet past the folded edge of the leaflet. An off-center tearing line of weakness is arranged on the outer sheet adjacent to the leaflet to allow the label to be torn open and provide access to the leaflet. Preferably, a second line of tearing weakness is provided on the outer sheet to define a tear strip. A releasable medium is provided on the inner sheet beneath the tear strip to facilitate opening of the label and to inhibit damage thereto. The present invention further discloses a method of making such labels.

17 Claims, 4 Drawing Sheets

MULTI-LAYERED LABELS

FIELD OF THE INVENTION

The present invention generally relates to labels and, more particularly, to labels intended to be adhesively secured to an outer surface of a product such as bottles, canisters, cartons and the like. The present invention also concerns a process for producing adhesive labels.

BACKGROUND OF THE INVENTION

As will be appreciated, certain types of products require an extensive amount of informational data to be provided to the user regarding the enclosed product. As an example, bottles containing pharmaceuticals normally require extensive labeling information for the user. Product liability laws, governmental labeling requirements, and instructional use guidelines further adds to the extensiveness of the label contents.

Labels having multiple page leaflets which may be opened for reading are well known in the art. Label manufacturers, however, are continually attempting to reduce the cost of manufacturing the labels. Increasing the speed by which the labels can be applied to an outer surface of the containers is another goal sought to be achieved.

A multi-layered label is particularly difficult to apply to a curved outer surface of a product. The multi-layered structure of heretofore known adhesive labels normally causes these labels to wrinkle during the application process, and thus these labels appear unsightly on the face of the container or product. Another problem with heretofore known adhesive labels is that, after being opened, the leaflet often becomes disassociated with the container or product. Accordingly, the user has a serious problem in associating which label goes with what product.

Still another problem with labels involves the ergonomics associated with opening of the label. Some multi-layered label structures include a tearing line of weakness along an outer cover sheet of the label. To gain access to the leaflet requires the user to open the label by tearing along such line of weakness. The arrangement of such tearing line of weakness on the label controls whether the label is opened from the left or from the right. Moreover, it is desirable to make the label "user friendly". Some labels are provided with a small slit at the top of the label to allow the label to be opened along the line of weakness. For an operator to gain access to this slit or cut, however, has proven frustrating and time-consuming.

Thus, there is a need and a desire for a multi-layered label having a leaflet contained thereon and which is structured to be readily openable to provide access to the leaflet as well as facilitating its application in a non-wrinkled fashion to a curved outer surface of a product.

SUMMARY OF THE INVENTION

In view of the above, an important aspect of the present invention concerns the provision of a multi-layered label which can be easily opened thereby providing access to a multi-page leaflet. The label of the present invention includes inner and outer sheets arranged in overlying relation relative to each other with an adhesive therebetween. The inner and outer sheets are generally laterally aligned relative to each other along respective first side edges and are adhered to each other along an end region extending laterally inward from the laterally aligned edges of the sheets. The multi-page leaflet is arranged in a folded configuration between the sheets with one folded edge of the leaflet being generally laterally aligned with the second side edge of the inner sheet and the other folded edge of the leaflet being laterally spaced inwardly from the laterally aligned first edges of the sheets. Notably, the outer sheet extends over and laterally beyond the second edge of the inner sheet and past the folded edge of the leaflet. In a most preferred form of the invention, a tear strip is provided on the outer sheet preferably on the end region between the laterally aligned edged of the sheets and the folded edge of the leaflet. A salient feature of the present invention concerns the provision of a release medium which underlies the tear strip and thereby promotes a clean separation of the tear strip from the inner sheet while facilitating opening of the label.

The tear strip is preferably defined by parallel lines of tearing weakness extending between upper and lower edges of the outer sheet. One of the tearing lines is preferably provided immediately adjacent to the folded edge of the leaflet. To enhance opening the label, each line of tearing weakness comprises a series of vertically spaced generally parallel perforations. The perforations may be oriented on the outer sheet to angle toward one edge of the label to facilitate opening of the label. In a most preferred form of the invention, the tear strip includes a tab at one end thereof and which extends beyond an edge of the label to facilitate grasping of the tear strip and thereby enhancing opening the label.

In a preferred form of the invention, inner and outer layers or pages of the leaflet are adhered to the respective inner and outer sheets of the label. The inner layer or page of the leaflet is joined to the remainder of the leaflet along a line of tearing weakness arranged adjacent to the folded edge of the leaflet. Moreover, the inner and outer pages of the leaflet may have identical informational data provided thereon.

The arrangement of the tear strip and the structure of the label promote the ergonomics involved with opening the label. When opening of the label is desired, the tear strip is grasped and torn from the outer sheet. It has been found that the user thereafter normally tends to open the label in a motion toward that end of the label wherein the outer sheet extends over and laterally beyond the label.

Configuring the label such that the outer sheet extends laterally beyond the inner sheet has at least two distinct advantages. First, extending the outer sheet laterally beyond the inner sheet and folded leaflet promote smooth adhesive applications of the label to a curved outer surface of a bottle or the like with minimal wrinkling. Wrinkling minimalization is effected with the label structure of the present invention because the second end of the outer sheet is not adhered to the inner sheet. Rather, the second end of the outer sheet adheres directly to the outer surface of the container thereby allowing a difference in stretch between the inner and outer sheets and thus minimizing wrinkling. Minimizing wrinkling, of course, is a distinct advantage with today's automated labeling techniques.

The second advantage realized by extending the outer sheet laterally beyond the inner sheet is closely tied to the ergonomic advantage offered by the present invention. After the label is opened through use of the tear strip, a continuing motion allows the informational leaflet to be separated along its line of tearing weakness to the inner layer as the outer sheet is completely removed from the container. As will be readily appreciated, separating the leaflet from the container promotes unfolding the various pages of the leaflet and facilitates reading thereof.

It has been found advantageous to use a transparent material such as plastic or the like for the outer sheet of the label. The plastic outer sheet acts as a protective cover and its transparency readily allows reading of the informational data on the outer layer or page of the multi-page leaflet. Providing identical informational data on inner and outer pages of the leaflet allows the inner page of the leaflet to remain adhered to the container thus providing a correlation between the contents of the container and the instructional leaflet after the leaflet has been removed from the container.

The inner sheet of the label is commonly fabricated from paper with an informational surface facing away from the bottle. Users are acutely sensitive to damage done to the labels after they have been opened. The releasable medium provided on the inner sheet in underlying relation to the tear strip facilitates opening of the label with minimal efforts while protecting the informational surface on the inner sheet from tearing or ripping damage when the adhesive underlying the tear strip separates from the inner sheet upon opening of the label. In a most preferred form of the invention, the release medium includes a silicone-like coating which is applied to the informational surface of the inner sheet.

The tab on the tear strip comprises a laminate structure including a relatively small portion of each of the inner and outer sheets. These relatively small portions preferably extend from an edge of the label and are adhered to each other by the adhesive on the back side of the outer sheet. The tab portion on the inner paper sheet is preferably configured to minimize damage to the informational surface or layer upon removal of the tear strip. In a most preferred form of the invention, a cut line laterally extends across the tab portion extending from the inner sheet. The cut line is preferably arranged proximate and parallel to that edge of the inner sheet from which the tabs extends. Thus, when the tear strip is used to open the label, the tab portion associated with the inner sheet of the label cleanly separates therefrom along the cut line to inhibit damage to the informational surface on the inner sheet.

Another important aspect of the present invention concerns a process for producing adhesive labels which are configured to be torn open. The label producing process according to the present invention includes the steps of: advancing a continuous laminate strip along a predetermined path of travel, with said laminate strip comprising a first layer having an informational surface and a back surface, the back surface of said layer being removably adhered to a second layer provided with a releasable medium on a surface facing said back surface of said first layer to facilitate separation of said layers; providing identifying information on the informational surface of said first layer; removing predetermined portions of the first layer from the laminate strip as it advances along the predetermined path of travel to establish a series of identical but separate leaflet receiving surfaces on said laminate strip, each leaflet receiving area having upper and lower edges which are separated by a first predetermined distance and first and second laterally spaced side edges which are spaced apart by a second predetermined distance; adhering an elongated informational bearing leaflet between the upper and lower edges of each leaflet receiving surface, each leaflet comprising a plurality of interconnected layers or pages arranged in overlying relation relative to each other and which define first and second laterally spaced side edges of said leaflet, with the lateral spacing between the side edges of said leaflet being less than said second predetermined distance, and with said leaflet being adhered to each leaflet receiving surface such that said second edge of each leaflet is generally laterally aligned with the second edge of each leaflet receiving surface, and wherein the layers of each leaflet have rows of identical informational bearing areas between the upper and lower edges thereof; adhering a continuous transparent cover sheet over the leaflet and leaflet receiving surfaces as they continually move along said predetermined path of travel, said cover sheet defining upper and lower edges which are separated by a distance substantially equal to at least said first predetermined distance and has adhesive across the bottom surface thereof; sizing the cover sheet so that only a predetermined size transparent layer of cover sheet extends over the leaflets and the first and second layers of said laminate strip, with each sized layer of cover sheet having a first side edge generally laterally aligned with the first side edge of the leaflet receiving surface and a second side edge which laterally extends beyond the generally aligned edges of the leaflet and leaflet receiving area and is adhered to the second layer of said laminate strip; providing an off-center tearing line of weakness on the cover sheet between the upper and lower edges thereof to facilitate access to the leaflet; and slitting the laminate structure, leaflets, and sized transparent layer of cover sheet between the upper and lower edges to provide separate rows of individual labels which are interconnected to each other by the second layer of laminate strip.

An improved process of producing the label may further include the step of removing the continuous laminate strip from a roll mounted toward one end of the predetermined path of travel. The label producing process may further include the step of winding the rows of interconnected labels onto rolls to facilitate automated application of the labels to containers having a curved outer surface.

In a most preferred form of the invention, the process for producing the labels may further include the step of providing a second tearing line of weakness adjacent to the first tearing line of weakness to define a tear strip therebetween and which vertically extends across each label thereby facilitating access to the overlying layers of each leaflet. An improved process for fabricating the label may further include the step of providing a releasable medium on each leaflet receiving area such that the releasable medium underlies the tear strip to facilitate opening of the label and thereby provide access to the leaflet without damaging the informational surface of each label.

To further enhance opening of each label, the label making process may further include the step of: providing a tab at one end of the tear strip during the process of cutting the cover sheet, said tab enhancing the ability to grasp the free end of the tear strip to open the label. To minimize damage to the label, the label making process may further include the step of providing a tearing line of weakness extending generally parallel to the edge of the first layer of the laminate strip from which the tab extends such that when the tab is pulled, the first layer of the label remains substantially intact without damage thus improving the aesthetic features thereof. According to the present invention, the process for manufacturing the label may further include the step of providing substantially similar informational data on lowermost and uppermost layers or pages of each leaflet so as to inhibit confusion when the leaflet is torn from the remaining portion of the label.

Numerous other features and advantages of the present invention will become readily apparent from the following detailed description, the accompanying drawings, and the appended claims.

DETAILED DESCRIPTION OF THE INVENTION

Figure 2:
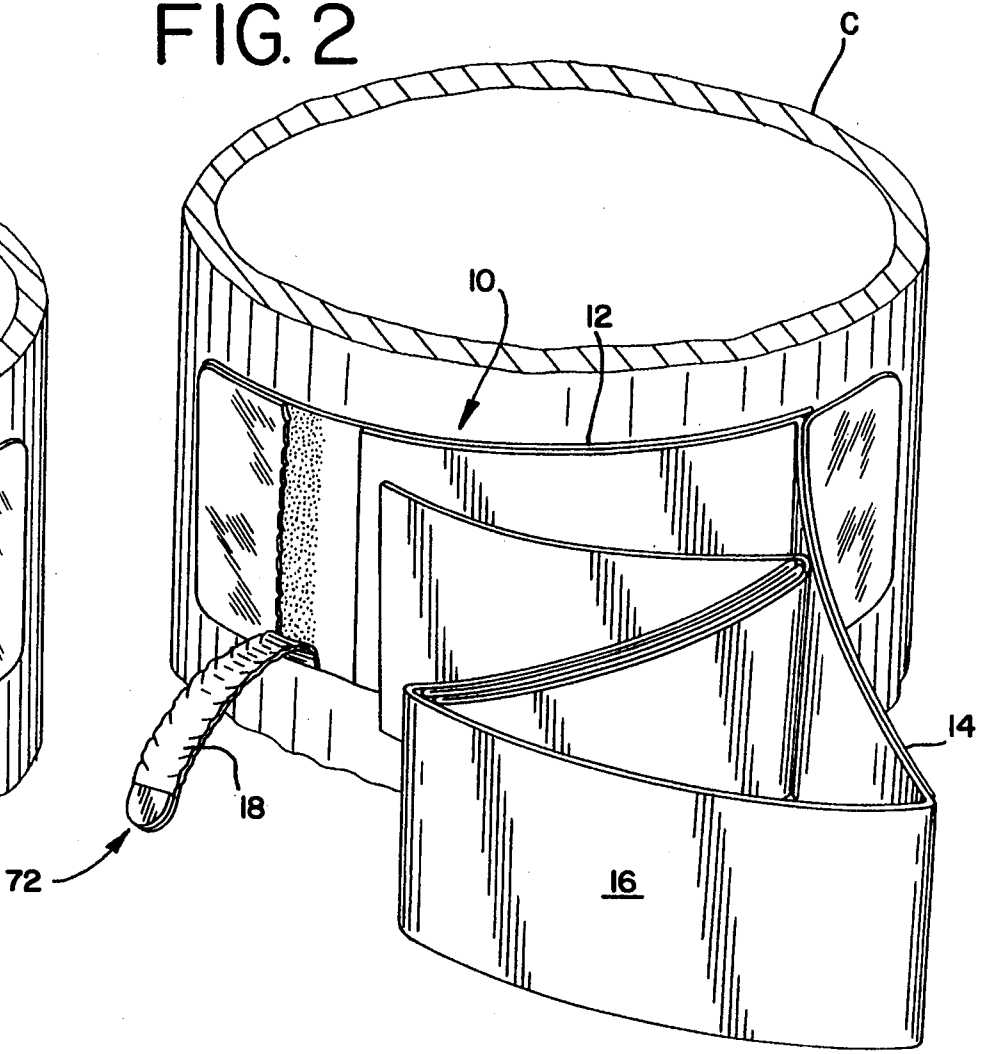
FIG. 2 is a perspective view similar to FIG. 1 showing the label in an open form to provide access to an informational leaflet.

While the present invention is susceptible of embodiments in various forms, there is shown in the drawings a preferred embodiment hereinafter described with the understanding that the present disclosure is to be considered as an exemplification of the invention, and is not intended to limit the invention to the specific embodiment illustrated.

Figure 1:
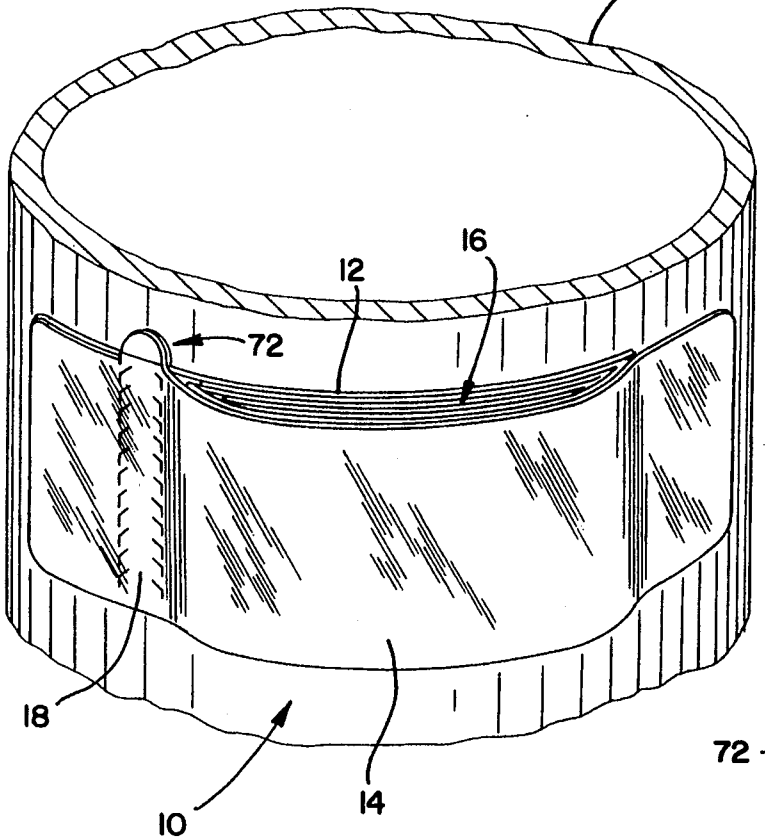
FIG. 1 is a perspective view of a label according to the present invention attached to a container.
Figure 3:
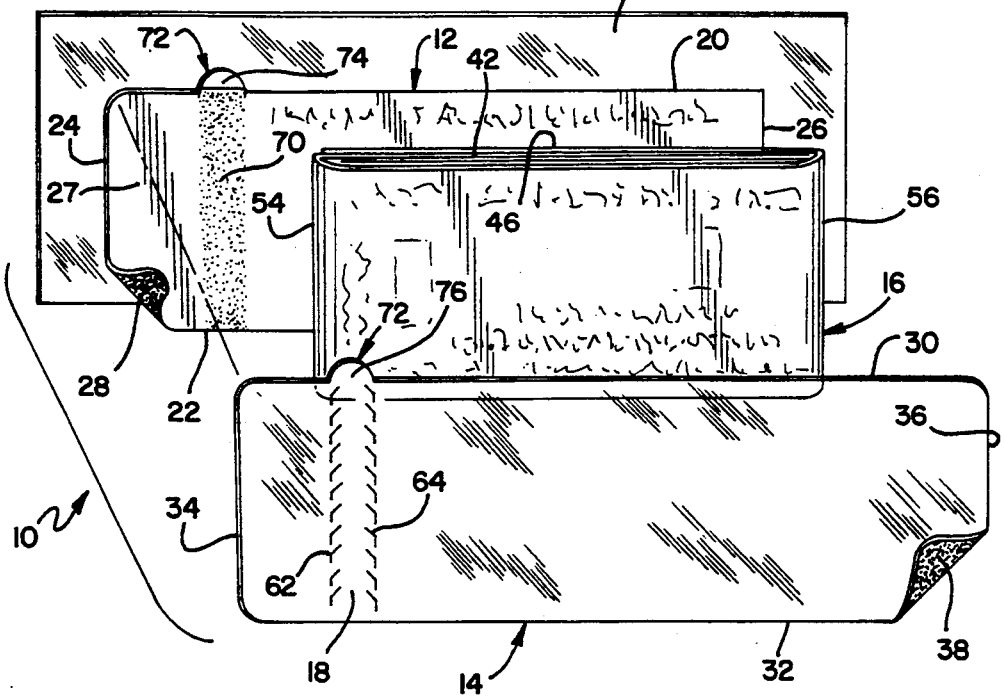
FIG. 3 is an exploded perspective view of a label according to the present invention prior to assembly.

Referring now to the drawings, wherein like reference numerals indicate like parts throughout several views, there is shown in FIG. 1 a label 10 which is designed to be adhesively secured to a container C by automatic machinery currently in commercial use. As particularly illustrated in FIG. 3, label 10 includes a base layer 12, a transparent cover sheet 14, and a relatively small informational pamphlet or leaflet 16 positioned in a folded configuration between base layer 12 and cover sheet 14. Turning to FIG. 2, label 10 further includes a tear strip 18, which facilitates opening of the label 10 to gain access to the leaflet 16 so as to unfold and read various layers thereon concerning the contents of the container C.

In a preferred form of the invention, base layer 12 is formed from paper having upper and lower edges 20 and 22, respectively, which are vertically spaced apart by a first predetermined distance and first and second side edges 24 and 26, respectively, which are laterally spaced apart by a second predetermined distance. In this preferred embodiment, an inner surface of base layer 12 defines an informational surface 27 while an outer surface of the base layer 12 is coated with a conventional pressure contact adhesive 28 and has a removable liner 29 protecting such contact adhesive. When the label 10 is to be applied to the container C, the backing or liner sheet 29 is removed to expose the adhesive 28.

In the illustrated embodiment, cover sheet 14 is formed from a transparent material such as plastic or the like. Cover sheet 14 has upper and lower edges 30 and 32, respectively, which are vertically spaced apart by said first predetermined distance, and first and second side edges 34 and 36, respectively, which are laterally spaced apart by a third predetermined distance. The cover sheet 14 also contains on its inner face a layer of pressure contact adhesive 38.

The leaflet 16 comprises a strip of paper which is folded into a series of overlapping layers or pages. Printed instructions or other information about the materials in the container is printed on layers of the leaflet. Preferably, the leaflet includes an inner layer 42 and an outer layer 44 with one or more layers therebetween. The layers 42 and 44 may be provided with substantially identical informational data thereon. In the illustrated embodiment, a back surface 46 of inner layer 42 is adhered to the base layer 12 of the label.

Figure 4:
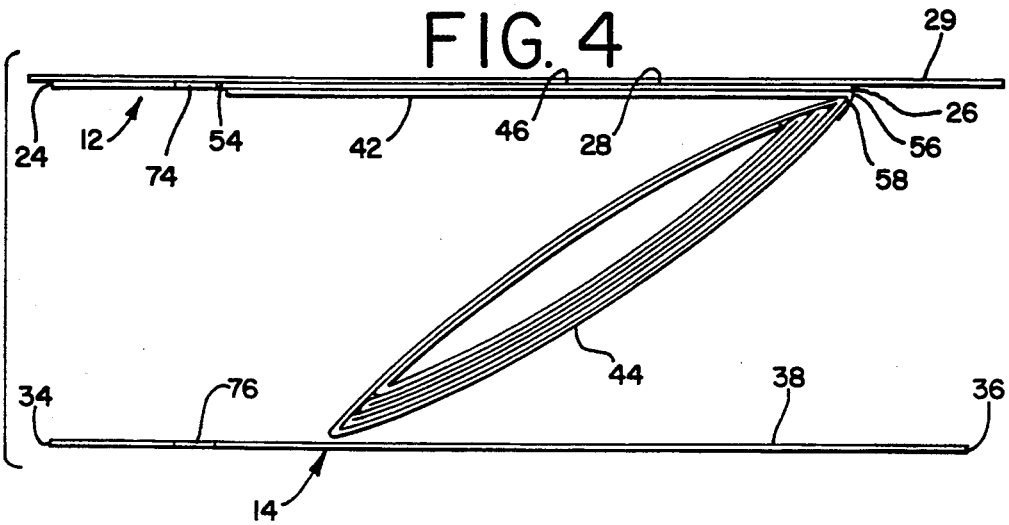
FIG. 4 is a top plan view of the label shown in FIG. 3.

When the layers of the leaflet 16 are arranged in a folded configuration, the leaflet defines first and second folded edges 54 and 56, respectively, are likewise first and second outermost edges 54 and 56 of label 10 in its folded configuration. Edges 54 and 56 are laterally spaced apart a distance which is less than the second predetermined distance separating side edges 24 and 26 of base layer 12. Leaflet 16 is provided with a vertical dimension substantially equal to the first predetermined distance separating upper and lower edges 20 and 22 of base layer 12. Notably, the inner layer 42 of the leaflet 16 is joined to the adjacent layers of the leaflet along a perforated or intermittently slitted vertical line 58 (FIG. 4) which is substantially coincident with the second folded edge 56 of the leaflet.

When label 10 is assembled, the second folded edge 56 of leaflet 16 is adhered preferably in lateral alignment with or proximate to the second edge 26 of base layer 12. Notably, the base layer 12, cover sheet 14, and leaflet 16 have substantially equivalent distances between upper and lower edges. Thus, the cover sheet 14 is adhered to the base layer 12 only in those areas wherein the leaflet 16 is not disposed therebetween. The lateral size differences between base layer 12 and leaflet 16 provides a lateral space or end region separating side edge 24 of base layer 12 from the folded side edge 54 of leaflet 16. Moreover, when label 10 is assembled, the first side edge 24 of base layer 12 and the first side edge 34 of cover sheet 14 are preferably generally laterally aligned in overlying relation to each other. The lateral size differences between base layer 12 and cover sheet 14 allows the cover sheet 14 to be adhered at one end region to the base layer 12 while extending laterally across the leaflet 16 and extending laterally beyond the second edge 26 of base layer 12 and second folded edge 56 of leaflet 16. The free end of cover sheet 14 releasably adheres to the liner 29 prior to application of the label onto the container C.

A salient feature of the present invention concerns the provision of tear strip 18 on the cover sheet 14 to facilitate opening of the label to provide access to the leaflet 16. The tear strip 18 is defined by a pair of laterally spaced generally parallel lines of tearing weakness 62 and 64. Each line of tearing weakness 62, 64 extends between the vertical edges 30, 32 of cover sheet 14. The laterally innermost tear line 64 is preferably arranged immediately adjacent to the first folded edge 54 of the leaflet 16 such that opening of the label provides immediate access to the leaflet 16.

In the illustrated embodiment, each tearing line of weakness 62, 64 is defined by a vertical line of slits or perforations 66. To enhance and to some degree control the openability of the tear strip 18, the perforation 66 are vertically spaced generally parallel perforations which are oriented on the cover sheet 14 to extend angularly toward one lower edge of the sheet 14.

The label 10 of the present invention is specifically designed to inhibit damage to the base layer 12 which remains on the container C after the label 10 is opened. To effect such ends, the base layer 12 is provided with a release medium 70 which underlies the tear strip 18 when cover sheet 14 is adhered to base layer 12. Notably, the release medium 70 vertically extends between the upper and lower edges 20 and 22 of the base layer 12 and is laterally spaced inwardly from the first edge 24 so as to underlie the tear strip 18 thus inhibiting the adhesive 38 on the inner surface of the cover sheet 14 and the tear strip 18 from adhering to the informational surface 27 of the base layer. In the illustrated embodiment, the releasable medium 70 includes a silicone-like material which is provided on the informational surface 27 of base layer 12 in a region underlying the tear strip 18. It will be appreciated that other forms of releasable mediums 70 may equally be used without departing from the true spirit and scope of the present invention.

Figure 5:
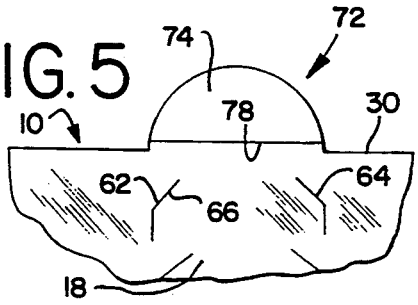
FIG. 5 is an enlarged elevational view of one embodiment of a tab provided on a tear strip of the label.

Toward one end, the tear strip 18 is preferably provided with a tab 72 to promote opening of the label 10. The tab 72 of label 10 is preferably configured as a laminate structure including overlying portions of both base layer 12 and cover sheet 14. In one form shown in FIG. 5, tab 72 of tear strip 18 is comprised of extensions 74 and 76 formed on base layer 12 and cover sheet 14, respectively. The extensions 74 and 76 can take different orientations on the label 10. On the embodiment shown, each extension 74, 76 extends vertically beyond the respective upper edges 20 and 30 of base layer 12 and cover sheet 14, respectively, to facilitate grasping of the tear strip 18 and opening of the label 10. In a most preferred form of the invention, base layer 12 is provided with a penetrating cut line 78 which laterally extends across the width of extension 74 on base layer 12 to facilitate clean separation of the tab portion 74 from the remaining portion of the base layer 12 upon opening of the label. Preferably, cut line 78 is generally aligned parallel with the edge of base layer 12 from which the extension protrudes. The purpose of cut line 78 is to allow the tab extension 74 to cleanly separate from the base layer 12 when the tear strip is torn open thereby minimizing damage to the informational surface 27 of base layer 12.

Figure 6:
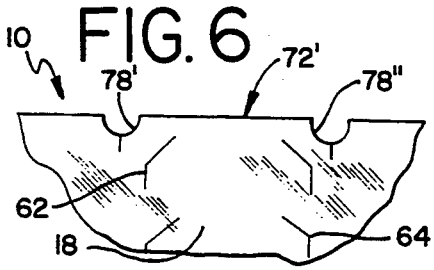
FIG. 6 is an enlarged elevational view of the second embodiment of a tab provided on a tear strip of the label.

An alternative tab configuration 72 is illustrated in FIG. 6. As mentioned above, the tab configuration may take different orientations on the label. In this embodiment, a pair of generally U-shaped cuts 78' and 78'' are provided along the upper edges 20 and 30 of base layer 12 and cover sheet 14, respectively, to define the upstanding tab portion 72' therebetween. Preferably, the cuts 78' and 78'' open to the upper edges 20 and 30 of base layer 12 and cover sheet 14, respectively, and are provided in general vertical alignment with or immediately adjacent to the tearing lines of weakness 62 and 64 on the label 10.

As mentioned, label 10 of the present invention is preferably applied to the container C during an automated process. Applying the label 10 to a curved outer surface of the container C would normally complicate the application process. A common problem which is incurred during the application process involves wrinkling of outer surface or layer of the label since the outer layer of the label needs to stretch a further distance than does the inner layer of the label during the application process. Arranging a multi-layered leaflet 16 between the outer and inner layers 12 and 14, respectively, further complicates the application process and further adds to the wrinkling problem.

An advantage of the present invention is that second side edge of the cover sheet 14 laterally extends beyond the base layer 12 and leaflet 16 such that the cover sheet 14 is directly adhered to the outer surface of the container C. This configuration has provided a simple and effective solution to the heretofore known wrinkling problem and provides the outer surface of the label 10 with a substantially wrinkle-free appearance.

When it is desired to gain access to the label 10 to unfold and read the informational data provided on the leaflet pages 16, one grasps the tab 72 of the tear strip 18 and pulls to open the label. Notably, the inclined tearing lines of weakness 62 and 64 facilitates opening of the tear strip 18. Moreover, providing the outermost and tear strip 18 immediately adjacent to the folded edge 54 of the leaflet 16 provides immediate access thereto. Arranging the release medium 70 beneath the tear strip 18 facilitates opening up the label and inhibits damage to the informational surface 27 on the base layer 12. Moreover, providing a line of weakness 78 along an upper edge 20 of the base layer 12 furthermore allows the tab 72 cleanly and clearly separate from the remaining portion of the base layer 12 while inhibiting damage to the informational surface 27 of the base layer.

As seen in FIG. 2, once the tear strip 18 is torn, immediate access is provided to the leaflet 16 such that the layers thereof may be unfolded as shown in FIG. 2 to read or study the information on the multiple layers of the leaflet. Notably, the upper or outer layer 44 of the leaflet 16 is adhered to the inner surface of the cover sheet 14. If so desired, the leaflet 16 can be removed from the container C by removing the cover sheet 14 and leaflet in combination with each other. Notably, the lines of tearing weakness 58 on the leaflet facilitates separation of the inner layer 42 of the leaflet 16 from the remaining multi-layers on the leaflet. Moreover, providing the tear strip 18 immediately adjacent to the leaflet 16 allows the leaflet 16 and remaining portion of cover sheet 14 to be cleanly removed from the container without affecting the informational surface 27 of the base layer 12. Notably, an end region of the cover sheet 14 remains in overlying relation to the end region of the base layer 12. Since the cover sheet 14 is preferably transparent, however, the information provided on the base layer 12 beneath that portion of the cover sheet is readily accessible. Additionally, providing informational data on the inner sheet 42 which is adhered to the base layer 12 and which informational data maybe substantially similar to the informational data provided on the outer sheet 44 of the leaflet 16 allows one to quickly and easily correlate which leaflet is associated with which container C notwithstanding the separation of the two. Accordingly, a multi-layered adhesive label 10 is provided which may be easily opened for reading extensive information contained thereon without jeopardizing disassociation between the container and the information should the leaflet 16 be separated from the container.

Figure 7:
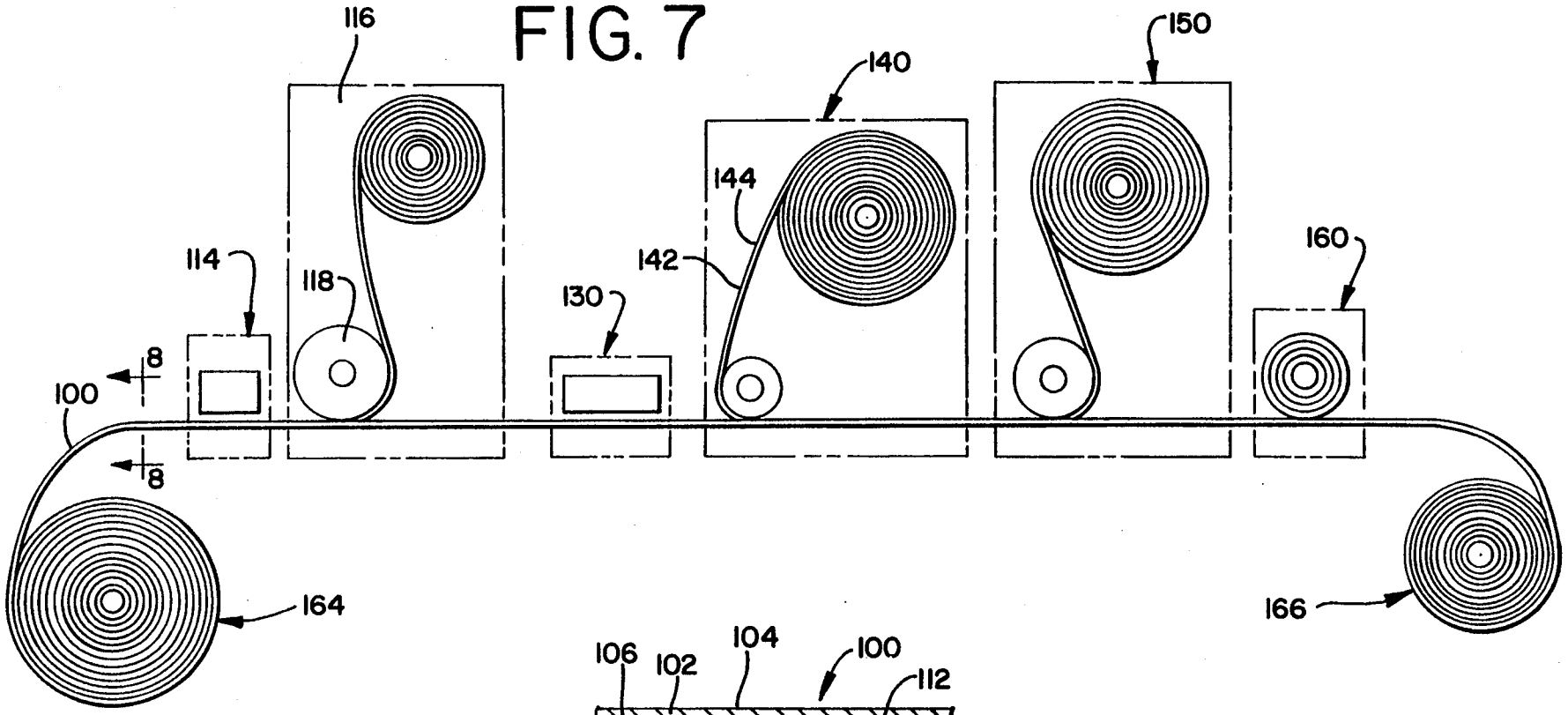
FIG. 7 is a side schematic view of a process for manufacturing a label.

Another aspect of the present invention concerns a process of making an adhesive label 10 similar to that discussed above which is to be torn open to provide access an informational multi-layered leaflet such as leaflet 16. The process involves a series of sequential steps which are accomplished at various stations. The individual machinery or apparatus for effecting such steps is commercially available technology and such machines or apparatus for effecting the process steps discussed below are schematically illustrated in FIG. 7 as various "stations".

Figure 8:
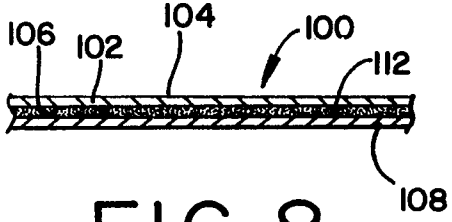
FIG. 8 is a fragmentary and enlarged sectional view of a portion of a laminate strip taken along line 8—8 of FIG. 7.

According to the present invention, the process for producing an adhesive label which is configured to be torn open comprises the steps of: advancing a continuous laminate strip 100 along a predetermined path of travel. As shown in FIG. 8, the laminate strip 100, initially introduced to the predetermined path of travel, comprises a continuous first layer 102 having an information surface 104 and a back surface 106. The back surface of the first layer 102 is removably adhered to a continuous second layer 108. In this embodiment, the second layer 108 is provided with a releasable medium on a surface 112 facing the back surface 106 of the first layer 102 to facilitate separation of the layers.

At station 114, identifying information is provided on the information surface 104 of the laminate strip. Identifying information may constitute date and bar code type information. Also at station 114, a series of parallel lines may be provided on the informational surface 104 of the first layer 102 thereby schematically separating the laminate strip into substantially equally divided but adjacent sections or areas.

Figure 9:
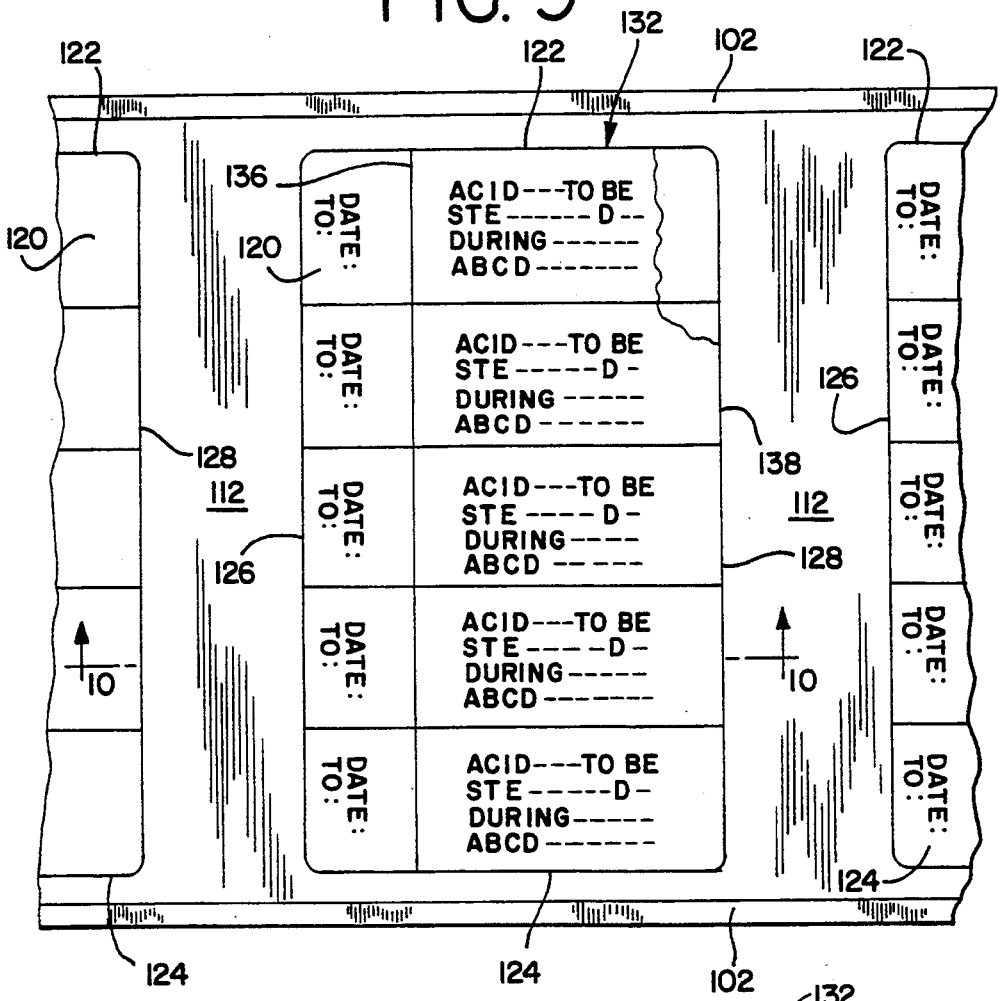
FIG. 9 is a fragmentary enlarged top plan view of the laminate strip as it advances along through the apparatus illustrated in FIG. 7.

At station 116, predetermined portions of the first layer 102 are removed from the laminate strip 100 as it advances along its predetermined path of travel. In a preferred form of the invention, the laminate strip 100 passes between a rotatable cutting die 118 which serves to cut and remove the predetermined portions of the first layer from the laminate strip. As seen in FIG. 9, as the laminate strip 100 passes from the station 116, a series of identical but separate leaflet receiving surfaces 120 are provided on the advancing laminate strip. Each leaflet receiving surface 120 has upper and lower edges 122 and 124, respectively, which are separated by a first predetermined distance and first and second laterally spaced side edges 126 and 128, respectively, which are spaced apart by a second predetermined distance.

Figure 10:
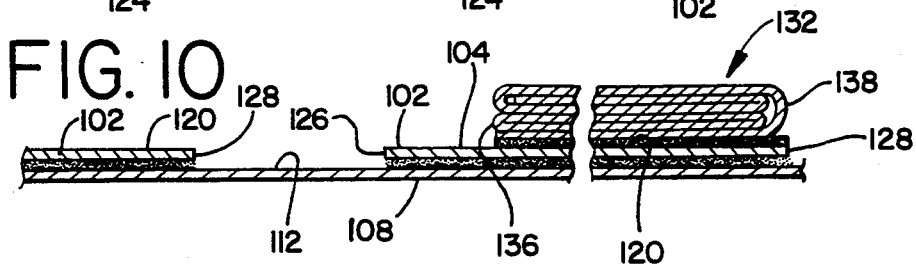
FIG. 10 is schematic side sectional view taken along line 10—10 of FIG. 9.

Returning to FIG. 7, the next step in the process involves passing the leaflet receiving surfaces 120 through station 130. At station 130, and as shown in FIG. 9, an elongated multiple-up informational bearing leaflet 132 is adhered between the upper and lower edges 122 and 124, respectively, of each leaflet receiving area 120. As shown in FIG. 10, each leaflet 132 comprises a plurality of interconnected layers or pages arranged in overlaying relation relative to each other. The pages of the multiple-up leaflet are folded to define first and second laterally spaced folded edges 136 an 138, respectively, which are likewise first and second outermost edges 136 and 138, respectively, for the leaflet 132. Notably, identical information is printed on a plurality of rows of separated areas of the layers of each leaflet between the folded and outermost side edges 136 and 138 and between the upper and lower edges of the elongated leaflet. At station 130, the elongated informational bearing leaflet 132 is adhered to each leaflet receiving surface preferably in lateral alignment with or proximate to the second edge 128 of each leaflet receiving surface 120.

Turning again to FIG. 7, at station 140, a continuous transparent cover sheet 142 is adhered over the leaflets 132 and leaflet receiving surfaces 120 as they continuously move along the predetermined path of travel. Although not shown, the cover sheet 142 defines upper and lower edges which are separated by a distance substantially equal to the first predetermined distance and has adhesive 144 along a bottom surface thereof.

Figure 11:
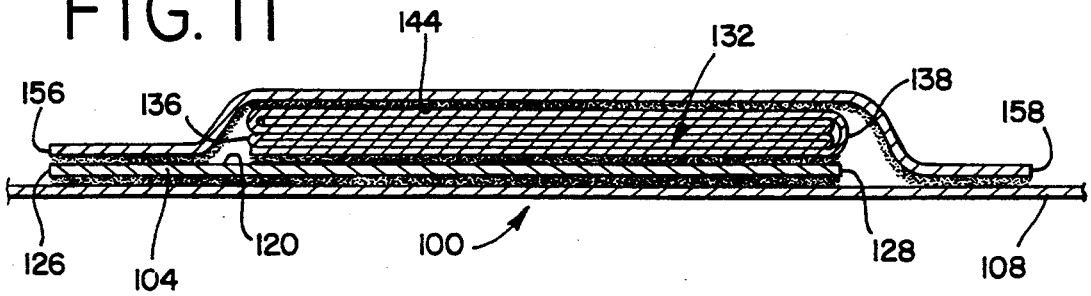
FIG. 11 is another schematic side sectional view similar to FIG. 9 but further along in the label making process.

At station 150, the cover sheet 142 is sized such that a predetermined size transparent layer of cover sheet extends over the leaflets 132 and the first and second layers 102 and 108 of the laminate strip. As illustrated in FIG. 11, the sized layer of cover sheet has a first side edge 156 generally laterally aligned with the first side edge 126 of each leaflet 132 receiving surface 120 and a second side edge 158 which laterally extends beyond the generally aligned edges 128 and 138 of the leaflet receiving surface 120 and the laterally elongated leaflet 132, respectively. Notably, that end portion of the sized cover sheet extending laterally beyond the second side edge 128 of the leaflet of receiving surface 120 and the second folded edge 138 of the leaflet 132 adheres to the second layer 108 of the laminate strip 100.

At station 150, an off-center tearing line of weakness such as a line of perforations or the like is provided in the sized cover sheet 142 between the upper and lower edges thereof. This tearing line of weakness ultimately facilitates opening of the label to provide access to the leaflet.

At station 160, the laminate strip 100 including the leaflet receiving areas 120, leaflets 132 and sized transparent layer of cover sheet 142 are slit between their upper and lower edges to provide a row of labels which are interconnected to each other by the second layer 108 of laminate strip.

The process of producing labels as discussed above may further include the step of removing the continuous laminate strip 100 from a continuous roll 164 mounted toward one end of the predetermined path of travel along which the laminate strip 100 traverses. The process of making labels may further include the step of winding the rows of interconnected labels which leave station 160 onto individual rolls 166 thus facilitating their automated application to a container or other receptacle.

At station 160, an additional or second tearing line of weakness may be provided on the sized cover sheet which is adjacent to the first tearing line of weakness. The pairs of tearing lines of weakness may be similar to that illustrated by reference numerals 62 and 64 discussed above. Such tearing lines of weakness combine to define a tear strip extending across each label thereby facilitating opening of the label to provide access to the overlying layers of each leaflet.

To enhance the openability of the labels produced by the above identified process, a release medium can be provided on each leaflet receiving area 120. The process of providing a releasable medium may be affected at station 114 and is preferably provided on each leaflet receiving area such that the releasable medium is arranged beneath the tear strip thereby facilitating opening of the label to provide access to the leaflet.

To further enhance the openability of each label, a tab similar to that discussed above may be provided at the end of the tear strip. Such a tab portion may be cut from the laminate strip as it passes through station 160 or at another suitable station provided along the predetermined path of travel.

The label forming process of the present invention is facilitated by providing identical informational data on lowermost and uppermost layers of each leaflet. Accordingly, when a leaflet is torn from the remaining portion of the label, similar information data will remain on the container as provided on the leaflet.

Regarding those labels having a tear strip thereon, the label making process may be further enhanced by providing a tearing line of weakness (similar to the cut line of 78 illustrated in FIG. 5) which extends generally parallel to that edge of each label from which a tab extension protrudes on the first layer 102 of the laminate strip. The provision of such a cut line is preferably provided at station 116. The cut line is provided such that when the tear strip is pulled to open the label, the tab of the tear strip will cleanly separate from the remaining portion of the label thus inhibiting damage to the informational bearing surface thereof.

Although the process described above is schematically illustrated as a continuous line of stations, it should be appreciated that such stations may be independent of each other. In such an arrangement, the processes are carried out individually and the resultant product of each station may be transported to an additional station for further processing.

From the foregoing, it will be observed that numerous modifications and variations can be effected without departing from the true spirit and scope of the novel concept of the present invention. It will be appreciated that the present disclosure is intended as an exemplification of the present invention, and is not intended to limit the present invention to the specific embodiment illustrated. The disclosure is intended to cover by the appended claims all such modifications as fall within the scope of the claims.

What is claimed:

1. A multi-layered label which is configured to be torn open, said label comprising:

a base layer having first and second side edges which are laterally spaced apart by a first distance, said base layer having an outer surface with at least a portion thereof having adhesive provided thereon to adhere the label to a product;

a transparent cover sheet having first and second side edges which are laterally spaced apart by a second distance, an inner surface of said cover sheet having adhesive thereon to affix said cover sheet in overlying relation to said base layer with the first side edges of said base layer and said cover sheet being generally laterally aligned relative to each other and with the second side edge of said cover sheet laterally extending beyond the second side edge of said base label to promote affixation of said label to the product;

a multi-layered leaflet positioned in a folded configuration between said base layer and said cover sheet, said leaflet in the folded configuration having at least an inner and an outer layer with at least a portion of one of said inner or outer layers having adhesive provided thereon so that said leaflet, can be adhered to a respective inner surface of said base layer and cover sheet, and wherein said leaflet in the folded configuration has first and second outermost edge laterally separated by a third distance such that said third distance is less than said first distance and with said second outermost edge of said folded leaflet being generally laterally aligned with the second side edge of the base layer; and wherein said cover sheet is provided with two generally parallel tearing lines extending across said cover sheet, said tearing lines being between said first outermost edge of said folded leaflet and the first edge of said cover sheet to define a tear strip therebetween and wherein said tear strip overlies a release medium provided on said base layer to promote a clean separation of said tear strip from said base layer and to facilitate opening of said label when said tear strip is torn along said parallel lines to permit access to said leaflet.

2. The multi-layered label according to claim 1 wherein one of said tearing lines is provided immediately adjacent to the first outermost edge of said folded leaflet such that opening of said label permits immediate access to said leaflet.

3. The multi-layered label according to claim 1 wherein said tear strip includes a tab portion which extends vertically beyond a vertical edge of said cover sheet to facilitate grasping of the tear strip and opening of the label.

4. The multi-layered label according to claim 1 wherein said base layer, said cover sheet and said leaflet each have vertically spaced edges separated by substantially equal distances.

5. The multi-layered label according to claim 1 wherein said inner layer of said folded leaflet is adhered to an inner surface of said base label while said outer layer of said folded leaflet is adhered to an inner surface of said cover sheet, wherein said leaflet has a tear line between said inner layer and the remainder of said leaflet such that the remainder of said leaflet may be torn from said inner layer of said leaflet along said tear line to allow a portion of the leaflet to remain affixed to the product after said label is opened.

6. A multi-layered label comprising:

a base layer having upper and lower edges which are vertically spaced apart by a first distance and first and second side edges between said upper and lower edges, said first and second side edges being laterally spaced apart by a second distance, with an outer surface of said base layer having adhesive thereon to affix said base layer to a product;

a transparent cover sheet having upper and lower edges which are vertically spaced apart by said first distance and first and second side edges between said upper and lower edges of said cover sheet and which are laterally spaced apart by a third distance, with an inner surface of said cover sheet having adhesive thereon to affix said cover sheet in overlying relation to said base layer, with the first side edges of said base layer and said cover sheet being generally aligned relative to each other, and with the second side edge of said cover sheet extending laterally beyond the second side edge of said base layer;

a multi-layered leaflet positioned in a folded configuration between said base layer and said cover sheet, the folded configuration of said leaflet having a vertical dimension substantially equal to said first distance and a lateral dimension between first and second outermost edges which is less than said second distance, and wherein an outer layer of said folded leaflet is adhered to an inner surface of at least one of said base layer and said cover sheet such that said first outermost edge of said folded leaflet is generally aligned with the second side edge of said base layer; and wherein said cover sheet is provided with a generally vertical tear strip defined by two generally parallel tear lines extending between said upper and lower edges of said cover sheet, said tear strip being provided between said second outermost edge of said folded leaflet and the first edge of said cover sheet, and with a release medium provided on said base layer beneath the tear strip to promote a clean separation of said tear strip from said base layer and to facilitate opening of said label and to provided access to said leaflet.

7. The multi-layered label according to claim 6 wherein one of said tear lines is laterally positioned proximate to the second outermost edge of said leaflet to facilitate opening of said label to gain access to said leaflet.

8. The multi-layered label according to claim 6 wherein said release medium on said base layer comprises a silicone covering positioned beneath and at least between said tear lines to inhibit tearing of the base layer upon opening of the layer.

9. The multi-layered layer according to claim 6 wherein each tear line on said cover sheet comprises a series of vertically spaced generally parallel perforations which are oriented on the cover sheet to extend angularly downwardly toward the lower edge of the cover sheet.

10. The multi-layered label according to claim 6 wherein an outer layer of said leaflet has an information surface facing said cover sheet and a back surface adhered to said base layer, with said outer layer being joined to the remainder of said leaflet by a line of weakening provided at the first folded edge of the leaflet opposite from the tear strip on the cover sheet.

11. The multi-layered label according to claim 6 wherein said tear strip is provided with a tab portion which extends vertically beyond an edge of the cover sheet to facilitate opening of the label.

12. The multi-layered label according to claim 11 wherein said tab portion of said tear strip is a laminate including a portion of said cover sheet overlying a portion of said base layer.

13. The multi-layered label according to claim 12 wherein a line of weakening releasably separates the tab portion from the remainder of the base layer to allow the tear strip to be torn from the label while inhibiting any portion of the base layer beneath said line of weakening to be affected when said label is opened.

14. A multi-layered label which is configured to be torn open, said label comprising:

inner and outer sheets having laterally spaced apart first and second side edges, said inner and outer sheets being arranged in overlying relation relative to each other and with an adhesive layer between said inner and outer sheets for at least a portion thereof, said sheets being bonded together along one end region by the adhesive layer and with an opposite end of the outer sheet extending laterally beyond the inner sheet to be adhered to product;

a leaflet comprised of a series of overlapping layers arranged in a folded configuration and being between said opposed side edges of said sheets, with at least one layer of said leaflet being adhered to said outer sheet, wherein the folded configuration of said leaflet is sized such that said end region of said inner and outer sheets laterally extends beyond a first outermost edge of said folded leaflet and said outer sheet laterally extends beyond a second outermost edge of said folded leaflet; and wherein said outer sheet includes a pair of laterally spaced generally parallel lines of tearing weakness defining a tear strip therebetween, said pair of tearing lines both being provided on said outer sheet and both lines being between the first outermost edge of said folded leaflet and a terminal edge of said end region, with a release medium being provided on said inner sheet in underlying relation to said tear strip to promote a clean separation of said tear strip from said inner sheet and to facilitate opening of said label to gain access to the leaflet by tearing said tear strip along said tearing lines.

15. The multi-layered label according to claim 14 wherein each line of tearing weakness on said outer sheet comprises a series of spaced generally parallel perforations which are angularly oriented to extend downward toward a lower edge of the outer sheet to promote opening of said label.

16. The multi-layer label according to claim 14 wherein informational data is provided on an outer most layer of said leaflet and wherein said outer sheet is transparent to readily provide visual access to said informational data.

17. The multi-layered label according to claim 14 wherein said tear strip includes a tab portion extending vertically above an upper edge of said cover sheet to facilitate grasping of said tear strip and thereby opening of said label.

* * * * *